US005848793A

United States Patent [19]

Celis

[11] Patent Number: 5,848,793

[45] Date of Patent: Dec. 15, 1998

[54] WATER GAME

[76] Inventor: Edward Celis, 602 Rosemary Ln., Burbank, Calif. 91505

[21] Appl. No.: 916,313

[22] Filed: Aug. 22, 1997

[51] Int. Cl.[6] ..... A63B 63/00; F41J 5/00

[52] U.S. Cl. ..... 273/384

[58] Field of Search ..... 273/384, 386, 273/387, 389, 390, 391, 392

[56] References Cited

U.S. PATENT DOCUMENTS

| | | | |
|---|---|---|---|
| D. 334,044 | 3/1993 | Lopajin | 273/384 X |
| 4,093,228 | 6/1978 | Pierce | 273/384 |
| 4,466,616 | 8/1984 | Griego | 273/384 |
| 4,702,480 | 10/1987 | Popeski et al. | 273/384 |
| 5,087,054 | 2/1992 | O'Neil | 273/384 |
| 5,390,913 | 2/1995 | Kepler | 273/384 |
| 5,482,292 | 1/1996 | Stone | 273/384 |

*Primary Examiner*—William H. Grieb

[57] ABSTRACT

A water game is provided including a stand having at least one leg with a rotation bar coupled thereto. Further provided is a water assembly including a water basin coupled along the rotation bar of the stand. The water assembly also includes a circular target coupled to the rotation bar of the stand opposite the water basin. As such, the water basin has an upright orientation situated on top of the interconnection bar of the stand and an inverted orientation situated below the interconnection bar of the stand.

4 Claims, 2 Drawing Sheets

WATER GAME

BACKGROUND OF THE INVENTION

1. Field of the Invention

The present invention relates to a water game and more particularly pertains to wetting a person upon striking a target with a projectile.

2. Description of the Prior Art

The use of target water games is known in the prior art. More specifically, target water games heretofore devised and utilized for the purpose of providing entertainment are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,093,228; U.S. Pat. No. 4,702,480; U.S. Pat. No. Des. 334,044; U.S. Pat. No. 5,087,054; U.S. Pat. No. 4,466,616; and U.S. Pat. No. 5,390,913.

In this respect, the water game according to the present invention substantially departs from the conventional concepts and designs of the prior art, and in so doing provides an apparatus primarily developed for the purpose of wetting a person upon striking a target with a projectile.

Therefore, it can be appreciated that there exists a continuing need for a new and improved water game which can be used for wetting a person upon striking a target with a projectile. In this regard, the present invention substantially fulfills this need.

SUMMARY OF THE INVENTION

In view of the foregoing disadvantages inherent in the known types of target water games now present in the prior art, the present invention provides an improved water game. As such, the general purpose of the present invention, which will be described subsequently in greater detail, is to provide a new and improved water game which has all the advantages of the prior art and none of the disadvantages.

To attain this, the present invention essentially comprises a stand including a pair of inverted V-shaped legs each in a spaced parallel configuration, as shown in FIG. 1. The inverted V-shaped legs are equipped with a horizonal interconnection bar formed therebetween. The interconnection bar includes a pair of hollow end extents fixedly coupled to an apex of an associated one of the legs and a hollow central extent. The hollow central extent is rotatably coupled in linear alignment with the extend extents. Such coupling is shown in FIG. 4. Also included is a water assembly. The water assembly comprises a water basin having a rectangular bottom face coupled along the length of the central extent of the interconnection bar of the stand. Coupled to the bottom face is a pair of inverted trapezoidal side faces, a forwardly extending front face, and a rearwardly extending rear face. The water assembly further includes a circular target coupled at an end of a post. Such post is in turn coupled to the central extent of the interconnection bar of the stand opposite the water basin. By this structure, the water basin has an upright orientation situated on top of the interconnection bar of the stand and an inverted orientation situated below the interconnection bar of the stand. Next provided is a rigid hose having a lower portion attached to one of the inverted V-shaped legs. The lower portion has a lower free end having a screwable coupling for connecting to a conventional garden hose. The hose further includes an upper portion having an inverted U-shaped configuration with a free end situated over the water basin. As such, when the water basin is in the upright orientation thereof, the hose serves to fill the basin with water. Finally, balance means is provided for maintaining the water basin in the upright orientation thereof when filled with water. The balance means further functions to allow the transfer of the water basin to the inverted orientation thereof upon a force of a predetermined magnitude being applied to the target. To accomplish this, the balance means includes a post coupled within the central extent of the interconnection bar of the stand. Note FIG. 4. The balance means further includes an L-shaped rod with a horizonal portion integrally coupled to the post and a vertical portion adapted to frictionally engage an interior surface of one of the end extents of the interconnection bar of the stand. As shown in FIG. 4, the end extent of the interconnection bar has a detent formed in the interior surface thereof. The detent is oriented such that the vertical extent of the L-shaped arm resides therein when the water basin is in the upright orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water game which has all the advantages of the prior art target water games and none of the disadvantages.

It is another object of the present invention to provide a new and improved water game which may be easily and efficiently manufactured and marketed.

It is a further object of the present invention to provide a new and improved water game which is of a durable and reliable construction.

An even further object of the present invention is to provide a new and improved water game which is susceptible of a low cost of manufacture with regard to both materials and labor, and which accordingly is then susceptible of low prices of sale to the consuming public, thereby making such water game economically available to the buying public.

Still yet another object of the present invention is to provide a new and improved water game which provides in the apparatuses and methods of the prior art some of the advantages thereof, while simultaneously overcoming some of the disadvantages normally associated therewith.

Still another object of the present invention is to wet a person upon striking a target with a projectile.

Lastly, it is an object of the present invention to provide a new and improved water game including a stand having at least one leg with a rotation bar coupled thereto. Further provided is a water assembly including a water basin coupled along the rotation bar of the stand. The water assembly also includes a circular target coupled to the rotation bar of the stand opposite the water basin. As such, the water basin has an upright orientation situated on top of the interconnection bar of the stand and an inverted orientation situated below the interconnection bar of the stand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
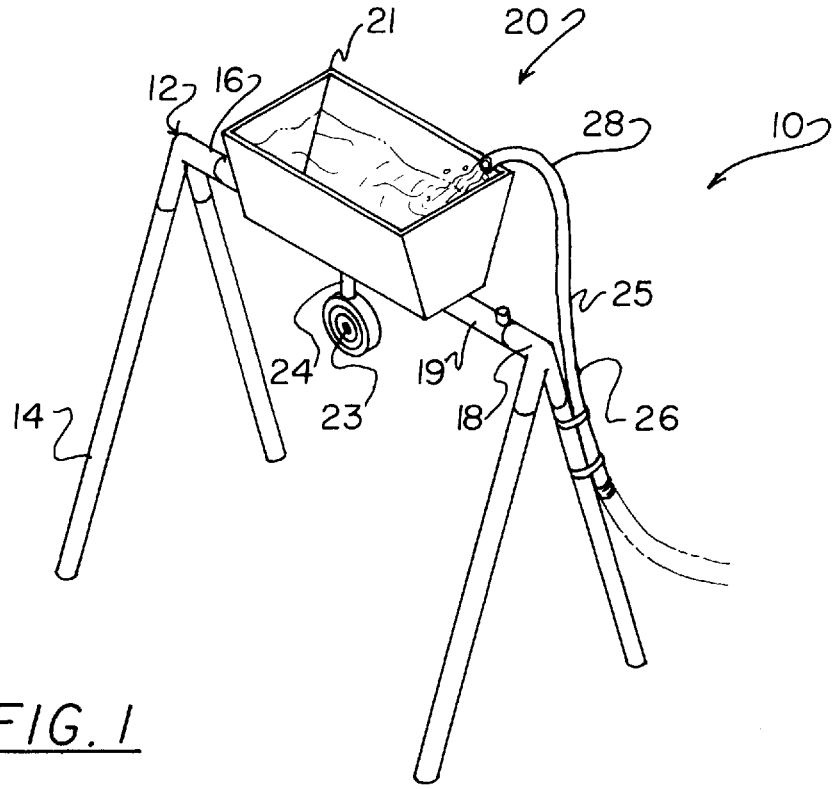
FIG. 1 is a perspective illustration of the preferred embodiment of the water game constructed in accordance with the principles of the present invention.
Figure 2:
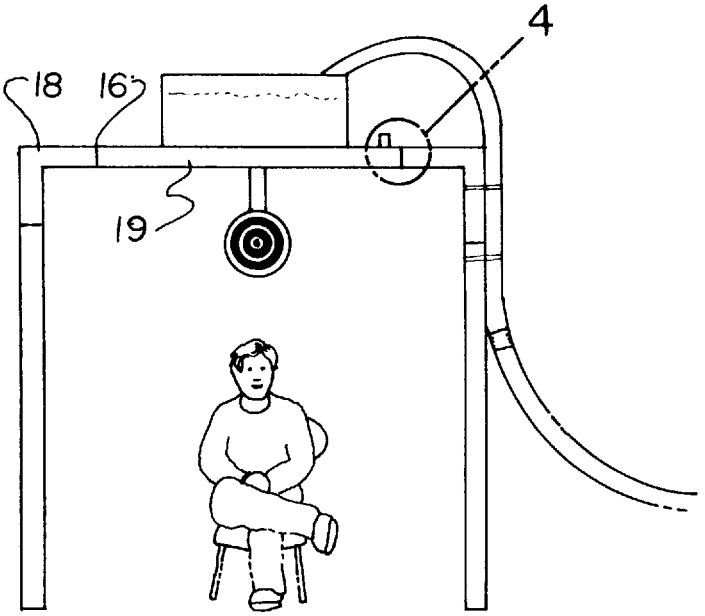
FIG. 2 is a front view of the present invention with the water basin in the upright orientation.

With reference now to the drawings, and in particular to FIG. 1 thereof, a new and improved water game embodying the principles and concepts of the present invention and generally designated by the reference numeral 10 will be described.

The present invention, the new and improved water game, is comprised of a plurality of components. Such components in their broadest context include a stand, a water assembly, and balance means. Such components are individually configured and correlated with respect to each other so as to attain the desired objective.

Figure 4:
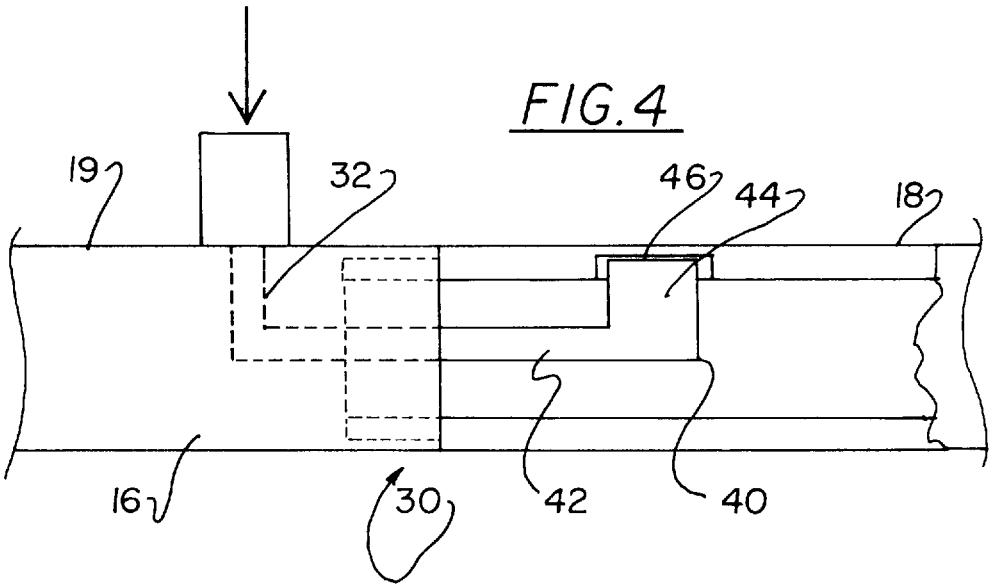
FIG. 4 is a cross-sectional view depicting the balance means of the present invention.
Figure 3:
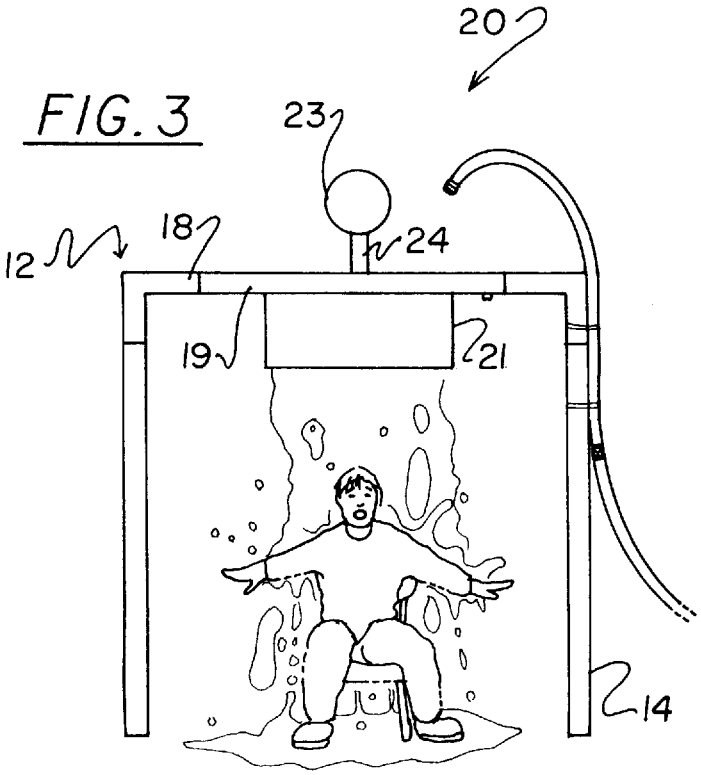
FIG. 3 is a front view of the present invention with the water basin in the inverted orientation.

More specifically, it will be noted that the system 10 of the present invention includes a stand 12 including a pair of inverted V-shaped legs 14 each in a spaced parallel configuration, as shown in FIG. 1. The inverted V-shaped legs are equipped with a horizonal interconnection bar 16 formed therebetween. The interconnection bar includes a pair of hollow end extents 18 fixedly coupled to an apex of an associated one of the legs and a hollow central extent. The hollow central extent 19 is rotatably coupled in linear alignment with the extend extents. Such coupling is shown in FIG. 4.

Also included is a water assembly 20. The water assembly comprises a water basin 21 having a rectangular bottom face coupled along the length of the central extent of the interconnection bar of the stand. Coupled to the bottom face is a pair of inverted trapezoidal side faces, a forwardly extending front face, and a rearwardly extending rear face. The water assembly further includes a circular target 23 coupled at an end of a post 24. Such post is in turn coupled to the central extent of the interconnection bar of the stand opposite the water basin. By this structure, the water basin has an upright orientation situated on top of the interconnection bar of the stand and an inverted orientation situated below the interconnection bar of the stand.

Next provided is a rigid hose 25 having a lower portion 26 attached to one of the inverted V-shaped legs. The lower portion has a lower free end having a screwable coupling for connecting to a conventional garden hose. The hose further includes an upper portion 28 having an inverted U-shaped configuration with a free end situated over the water basin. As such, when the water basin is in the upright orientation, the hose serves to fill the basin with water.

Finally, a balance means 30 is provided for maintaining the water basin in the upright orientation thereof when filled with water. The balance means further functions to allow the transfer of the water basin to the inverted orientation thereof upon a force of a predetermined magnitude being applied to the target.

To accomplish this, the balance means includes a post 32 coupled within the central extent of the interconnection bar of the stand. Note FIG. 4. The balance means further includes an L-shaped rod 40 with a horizonal portion 42 integrally coupled to the post and a vertical portion 44 adapted to frictionally engage an interior surface of one of the end extents of the interconnection bar of the stand. As shown in FIG. 4, the end extent of the interconnection bar has a detent 46 formed in the interior surface thereof. The detent is oriented such that the vertical portion of the L-shaped arm resides therein when the water basin is in the upright orientation. Upon the application of a force to the target, the vertical portion of the L-shaped arm is adapted to slip out of the detent thereby allowing the rotation of the central extent of the interconnection member. It should be noted that the detent preferably has side edges bevelled so that an amount of friction is afforded such that the tendency for the uprighted full basin to swivel is overcome by a slight amount.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved water game comprising, in combination:

a stand including a pair of inverted V-shaped legs each in a spaced parallel configuration with a horizonal interconnection bar formed therebetween, the interconnection bar including a pair of hollow end extents fixedly coupled to an apex of an associated one of the legs and a hollow central extent rotatably coupled in linear alignment with the extend extents;

a water assembly including a water basin having a rectangular bottom face coupled along the length of the central extent of the interconnection bar of the stand, a pair of inverted trapezoidal side faces, a forwardly extending front face, and a rearwardly extending rear face, the water assembly further including a circular target coupled at an end of a post which is in turn coupled to the central extent of the interconnection bar of the stand opposite the water basin, whereby the water basin has an upright orientation situated on top of the interconnection bar of the stand and an inverted orientation situated below the interconnection bar of the stand;

a rigid hose having a lower portion attached to one of the inverted V-shaped legs with a free end having a screwable coupling for connecting to a conventional garden hose and an upper portion having an inverted U-shaped configuration with a free end situated over the water basin when in the upright orientation thereof for filling the basin with water; and balance means for maintaining the water basin in the upright orientation thereof when filled with water and further adapted to allow the transfer of the water basin to the inverted orientation thereof upon a force of a predetermined magnitude being applied to the target, the balance means including a post coupled to the central extent of the interconnection bar of the stand and an L-shaped rod with a horizonal portion integrally coupled to the post and a vertical portion adapted to frictionally engage an interior surface of one of the end extents of the interconnection bar of the stand, whereby said end extent of the interconnection bar has a detent formed in the interior surface thereof which is oriented such that the vertical extent of the L-shaped arm resides therein when the water basin is in the upright orientation.

2. A water game comprising:

a stand including at least one leg with a rotation bar coupled thereto;

a water assembly including a water basin coupled along the rotation bar of the stand, the water assembly further including a circular target coupled to the rotation bar of the stand, whereby the water basin has an upright orientation situated on top of the interconnection bar of the stand and an inverted orientation situated below the interconnection bar of the stand; and a balance member connected between the stand and the water assembly for maintaining the water basin in the upright orientation by frictionally engaging an interior surface of the interconnection bar of the stand.

3. A water game as set forth in claim 2 wherein a rigid hose is included having a lower portion attached to the stand with a free end having a screwable coupling for connecting to a conventional garden hose and an upper portion situated over the water basin when in the upright orientation thereof for filling the basin with water.

4. A water game as set forth in claim 2 wherein the water basin has a rectangular bottom face, a pair of inverted trapezoidal side faces, a forwardly extending front face, and a rearwardly extending rear face.

* * * * *